US007661976B2

(12) United States Patent
Ma

(10) Patent No.: US 7,661,976 B2
(45) Date of Patent: Feb. 16, 2010

(54) ELECTRICAL CONNECTOR HAVING IMPROVED ELECTRICAL CONNECTION BETWEEN CONTACTS AND PINS OF THE PACKAGE FOR MINIMIZING THE CONNECTOR

(75) Inventor: Hao-Yun Ma, Tu-cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/229,373

(22) Filed: Aug. 21, 2008

(65) Prior Publication Data

US 2009/0053914 A1 Feb. 26, 2009

(30) Foreign Application Priority Data

Aug. 21, 2007 (CN) ..... 2007 2 0045422

(51) Int. Cl.
*H01R 13/625* (2006.01)
*H01R 4/50* (2006.01)

(52) U.S. Cl. ..... 439/342

(58) Field of Classification Search ..... 439/264–268, 439/68–73, 46, 66, 83, 342
See application file for complete search history.

(56) References Cited

U.S. PATENT DOCUMENTS 3,854,788 A * 12/1974 Goodman ..... 439/525
3,918,784 A * 11/1975 Lemke et al. ..... 439/70
4,052,117 A * 10/1977 Tengler et al. ..... 439/525
4,410,231 A * 10/1983 Senor ..... 439/525
4,420,215 A * 12/1983 Tengler ..... 439/723
4,637,670 A * 1/1987 Coller et al. ..... 439/180
5,013,256 A * 5/1991 Matsuoka et al. ..... 439/264
6,062,871 A * 5/2000 Arai et al. ..... 439/66
6,200,141 B1 * 3/2001 Sinclair ..... 439/66
6,383,007 B1 * 5/2002 Lin et al. ..... 439/342
6,402,537 B2 * 6/2002 Ikeya ..... 439/259
6,614,247 B2 * 9/2003 Ikeya et al. ..... 324/755
6,663,409 B1 * 12/2003 Liao et al. ..... 439/342
6,702,594 B2 * 3/2004 Lee et al. ..... 439/83
7,147,489 B1 * 12/2006 Lin ..... 439/83
7,175,462 B2 * 2/2007 Hashimoto ..... 439/342
7,318,736 B1 * 1/2008 Ambady et al. ..... 439/259

* cited by examiner

*Primary Examiner*—Chandrika Prasad
(74) *Attorney, Agent, or Firm*—Andrew C. Cheng; Wei Te Chung; Ming Chieh Chang

(57) ABSTRACT

The present invention provides an electrical connector for electrical connecting an IC package having a plurality of pins to a PCB. The electrical connector comprises a base defining a plurality of passageways, a plurality of contacts received in the passageways, and a cover moveable relative to the base from a first position to a second position. The cover defines a plurality of through holes corresponding the passageway. The contacts each have a resilient arm. During movement of the cover from the first position to the second position, pins of the IC package will compress the resilient arms of the contacts along a direction and the resilient will exert a normal force on the pins, thus ensuring proper connection between the resilient arm and the pins; wherein direction of the normal force is opposite to the direction of the pins moving.

20 Claims, 4 Drawing Sheets

Figure 1:
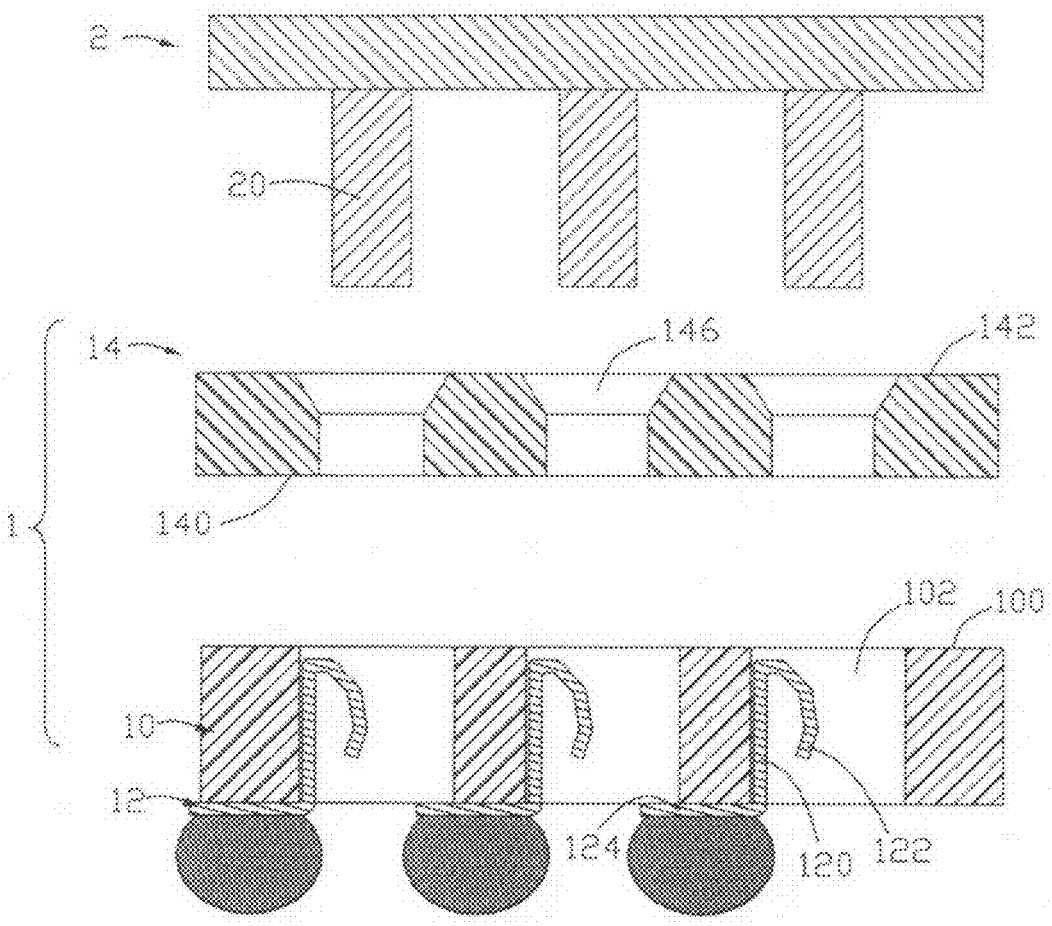

ELECTRICAL CONNECTOR HAVING IMPROVED ELECTRICAL CONNECTION BETWEEN CONTACTS AND PINS OF THE PACKAGE FOR MINIMIZING THE CONNECTOR

BACKGROUND OF THE INVENTION

1. Field of the Invention

The present invention relates to the art of electrical connectors. In detail, the present invention relates to a central processing unit (CPU) electrical connector/socket.

2. Background of the Invention

CPU sockets are widely used for establishing electrical connection between CPU and a printed circuit board (PCB)/motherboard. Therefore, CPU sockets are mounted on motherboards and hold CPUs execution of programs. Several types of CPU sockets are available with different structures. For example, type of Pin Grid Array (PGA) socket, which is found in U.S. Pat. No. 6,663,409 issued to Liao on Dec. 16, 2003.

A PGA socket generally comprises a base, a moveable cover mounted on the base, an actuator arranged between the base and the cover and a plurality of contacts received in the base. The base defines a plurality of passageways and the cover defines a plurality of through holes corresponding to the passageways. When the PGA socket connects the CPU to the PCB, the CPU is disposed upon the cover with its pins inserted into the through holes of the cover and the passageways of the base. The pins will contact with the contacts after a movement of the cover under a force from the actuator.

As known to all, the contact of a PGA socket generally comprises a pair of arms received in the passageway of the housing; thus a PGA socket is hardly to provide a high-density layout of the contacts because of the contact received in the housing requiring a large cavity.

In view of foregoing, a new electrical connector is needed to overcome the above-mentioned shortcomings.

SUMMARY OF THE INVENTION

Accordingly, an object of the present invention is to provide an electrical connector that maximizes the quantity of contacts and reduces the size of the housing.

To achieve the above-mentioned object, in a preferred embodiment of the present invention, the present invention provides an electrical connector for electrical connecting an IC package having a plurality of pins to a PCB. The electrical connector comprises a base defining a plurality of passageways, a plurality of contacts received in the passageways, and a cover moveable relative to the base from a first position to a second position. The cover defines a plurality of through holes corresponding the passageway. The contacts each have a resilient arm. During movement of the cover from the first position to the second position, pins of the IC package will compress the resilient arms of the contacts along a direction and the resilient will exert a normal force on the pins, thus ensuring proper connection between the resilient arm and the pins; wherein direction of the normal force is opposite to the direction of the pins moving.

Other objects, advantages and novel features of the present invention will become more apparent from the following detailed description when taken in conjunction with the accompanying drawings.

BRIEF DESCRIPTION OF THE DRAFLANGES

Figure 2:
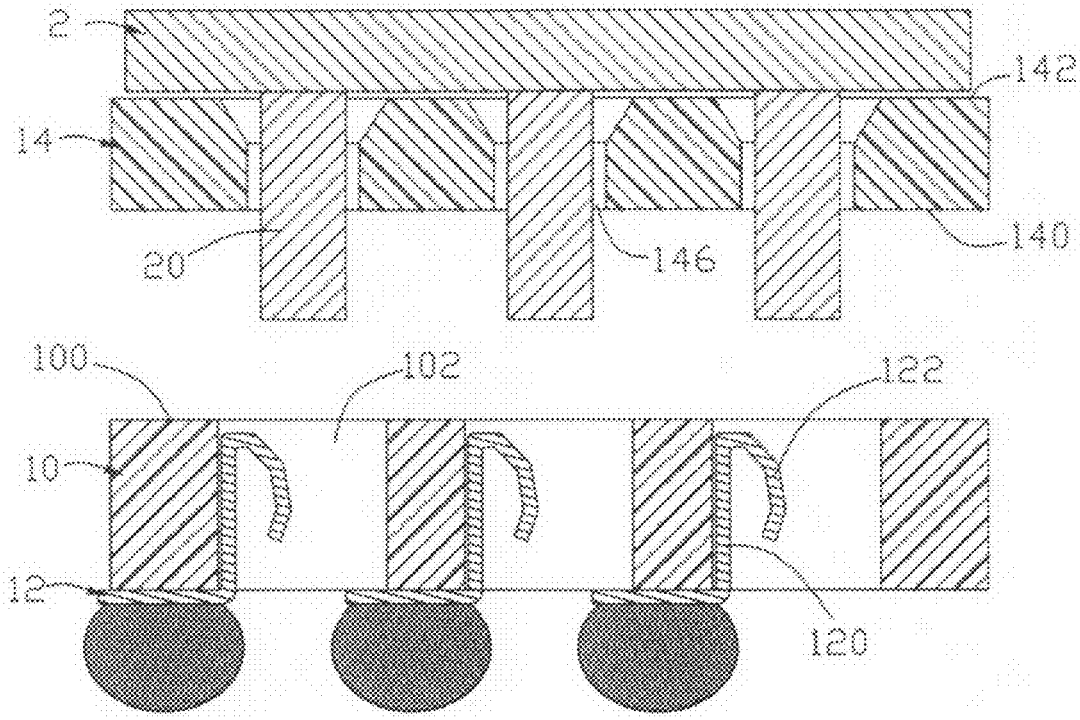
Figure 2A:
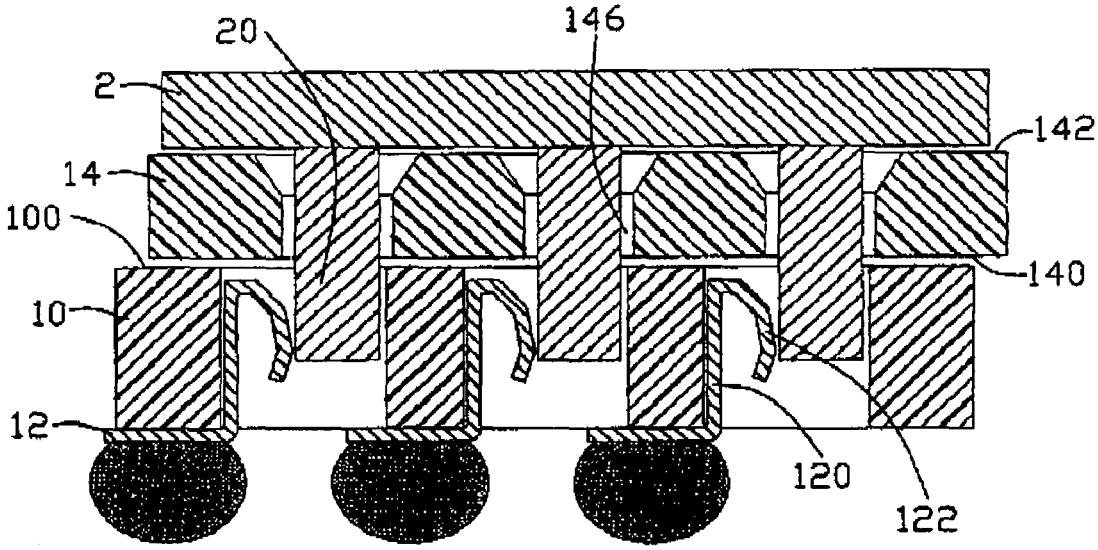

FIG. 1 is an exploded, sketch view of an electrical connector system in accordance with a preferred embodiment of the present invention, wherein the IC package is ready to be mounted on the electrical connector;

FIG. 2 is an illustrative sketch view of the electrical connector system; the IC package being mounted upon the cover without pushed toward the base; FIG. 2A shows illustratively the IC package mounted upon the cover with the pins inserted into the passageways respectively; and FIG. 3 is a sketch view of the electrical connector system, and the IC package is pushed toward the base and contacting with the contact after a sliding movement elative to the cover.

DETAILED DESCRIPTION OF THE PREFERRED EMBODIMENT OF THE INVENTION

Reference will now be made to accompany drawings to describe the present invention in detail.

Figure 3:
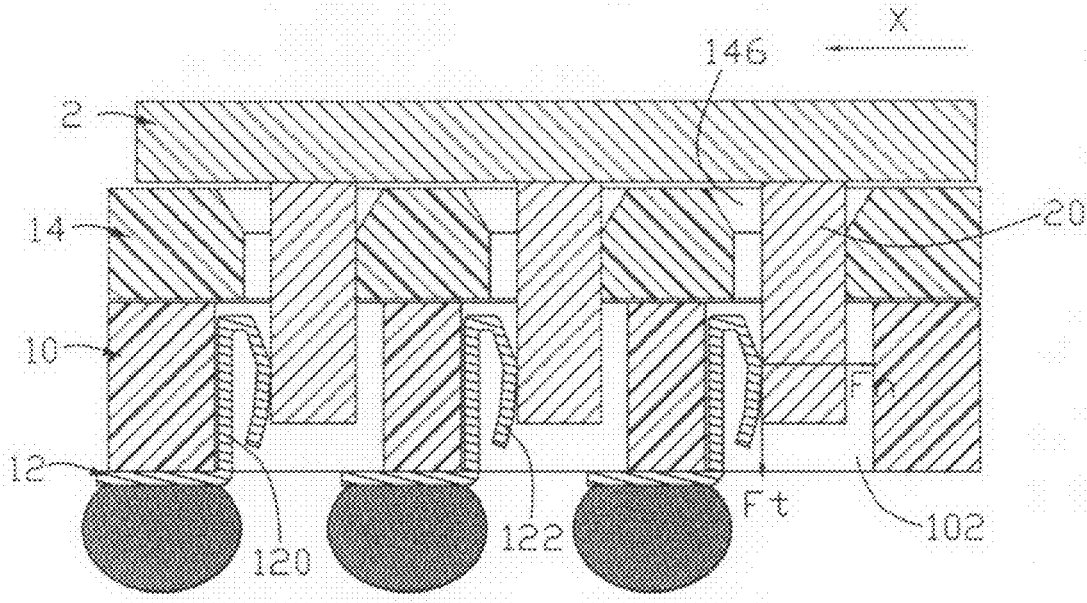

Referring to FIGS. 1-3, according to a preferred embodiment of the present invention, an electrical connector 1 used for establishing electrical connection between an IC package 2 (e.g. CPU) and a PCB (not shown) is shown.

The electrical connector 1 comprises base 10, a plurality of contacts 12 received in the base 10, and a cover 14. The base 10 has a mating surface 100 with a plurality of passageways 102.

The cover 14 is moveably mounted upon the base 10, defining a bottom surface 140 corresponding to the mating surface 100 of the base 10 and an upper surface 142 opposite to the bottom surface 140. A plurality of through holes 146 extends through both the upper surface 142 and the bottom surface 140. Each of the plurality of through holes 146 is configured to ensure a pin 20 of the IC package 2 to be inserted into. The plurality of through holes 146 each define a guiding slot (not labeled), which is formed by a chamfer arranged at a position near the upper surface 142.

Each of the plurality of contacts 12 is received in a passageway 102, and has a base portion 120 for securing the contact 12 in the passageway 102, a resilient arm 122 extending from one side of the base portion 120 and a soldering portion 124 extending from a lower end of the base portion 120. The resilient arm 122 extends along a direction of away the base portion 120 at first and then toward the base portion 122 along a direction near the base portion. The soldering portion 124 extends out of the passageway 102 and rests on a lower surface (not labeled) of the base 10. The resilient arm 122 and the soldering portion 124 are arranged on two sides of the base portion 120, respectively.

It is needed to point out; an actuator (not shown) will be arranged between the base 10 and the cover 14. As a conventional PGA socket, the actuator may be an eccentric cam or an operating lever. The actuator is used for driving the cover 14 to slide relative to the base 10 from a first position to a second position, which is well know to a people having ordinary skill in the art.

The IC package 2 is mounted upon the upper surface 142 of the cover and has a plurality of pins 20 corresponding to the through holes 146.

Referring to the FIGS. 2-3, a process of establishes electrical connection between the IC package 2 between the electrical connector 1 is shown. Referring to FIG. 2, the cover 14 is at the first position; pins 20 of IC package 2 being inserted into the through holes 146 of the cover 14. At this time, the pins 20 do not contact with any contacts 12. Referring to FIG. 3, while the cover 14 is at the second position after a sliding along an X direction, the pins 20 are contacting with the contacts 12.

During the movement of the cover 14 from the first position to the second position, the IC package 2 is also moved from the first position to the second position along a direction shown as arrow X in FIG. 3. In detail, the pins 20 of the IC package will move toward the resilient arm 122. The resilient arm 122 will be compressed and resiliently deformed to generate elastic force to assure mechanical and electrical engagement with the pins 20. The elastic force typically comprises a normal force $F_n$ and an axial force $F_t$. Direction of the normal force $F_n$ is opposite to the sliding direction of the cover 14 and the IC package 2, thus ensuring proper connection between the resilient arm 122 and the pins 20. The axial force $F_t$ will ensure proper connection between the IC package 2 and the cover 14. It is noted that the downward axial force $F_t$ results from the resilient arm 122 being essentially moved about the fulcrum, which is located, at the upper level, on the joint between the resilient arm 122 and the base portion 120.

Generally, the contact 12 of the present invention only needs one resilient arm, thus be of a simple structure. Moreover, a predetermined space between resilient arm of a contact of a PGA socket and inner wall of passageway of base of the PGA socket is generally required, the direction of the pins moving is opposite to the normal force $F_n$ of the resilient arm due to resiliently deformation. Therefore, the resilient arm and the pins will move nearly completely toward the predetermined space without in other direction and efficiency of using the predetermined space is increased.

Although the present invention has been described with reference to the accompanying drawings, it is not to be construed as being limited thereto. Various alterations and modifications can be made to the embodiments without in any way departing from the scope or spirit of the present invention as defined in the appended claims. Such modifications and alterations that may be apparent to a person skilled in the art are intended to be included within the scope of this invention as defined in by the accompanying claims.

What is claimed is:

1. An electrical connector for electrical connecting an Integrated circuit (IC) package having a plurality of pins to a Printed Circuit Board (PCB), comprising:

a base defining a plurality of passageways;

a plurality of contacts each received in a passageway, the contact having a resilient arm;

a cover mounted on the base and moveable relative to the base in a horizontal direction from a first position to a second position, the cover defining a plurality of through holes corresponding to the plurality of contacts of the base; and wherein after the IC package is mounted upon the cover and during movement of the cover from the first position to the second position, pins of the IC package will compress the resilient arms of the contacts along a horizontal direction and make the resilient arms deformed toward the base in said horizontal direction, and the resilient arm will exert a reactional force horizontally and axially on the pins under a condition that the IC package is seated upon the cover with the pins respectively extending through the corresponding through holes and into the corresponding passageways and moveable along with the cover in said horizontal direction, thus ensuring proper connection between the resilient arm and the pins;

wherein direction of the reactional force is opposite to the direction of pins moving.

2. The electrical connector as claimed in claim 1, wherein each of the contacts further comprises a base portion securing in one of the passageways, wherein the resilient arm extends from the base portion.

3. The electrical connector as claimed in claim 1, the contact further comprising a base portion securing in the passageway and a soldering portion arranged on a lower end of the base portion, wherein the resilient arm extends from the base portion.

4. The electrical connector as claimed in claim 3, wherein the soldering portion extends out of the passageway; the soldering portion and the resilient arm be arranged on two sides of the base portion, respectively.

5. The electrical connector as claimed in claim 4, wherein the soldering portion rests on a lower surface of the base.

6. The electrical connector as claimed in claim 5, wherein the resilient arm extends from an upper end of the base portion.

7. The electrical connector as claimed in claim 6, wherein the resilient arm is of a curved structure having an free end adjacent to the base portion.

8. An electrical connector assembly comprising:

an insulative base defining a plurality of passageways extending in a vertical direction;

an insulative cover mounted upon the base, being moveable relative to the base in a horizontal direction perpendicular to said vertical direction, and defining a plurality of through holes in vertical alignment with the corresponding passageways, respectively;

a plurality of contacts disposed in the corresponding passageways, respectively, each of said contacts defining a resilient arm with a fulcrum, at an upper level, about which the resilient arm is deflected; and an electronic package mounted upon the cover and defining a plurality of conductive pins each extending downwardly through the corresponding through hole and into the corresponding passageway; wherein said pin is horizontally moved toward the corresponding contact by horizontal movement of said cover along said horizontal direction to deflect and engage the resilient arm of corresponding contact so as to experience not only a reaction force in another horizontal direction, opposite to said horizontal direction, for enhancing horizontal connection between the pin and the contact, but a downward force for enhancing abutment between the cover and the electronic package.

9. The electrical connector as claimed in claim 8, wherein each of said contact passageway is of a through hole type in the vertical direction.

10. The electrical connector as claimed in claim 8, wherein said contact is upwardly assembled into the corresponding passageway from a bottom face of the base.

11. The electrical connector as claimed in claim 8, wherein each contact defines a horizontal solder tail exposed below the bottom face of the base.

12. The electrical connector as claimed in claim 11, wherein said solder tail is horizontally offset from the corresponding passageway.

13. The electrical connector as claimed in claim 8, wherein said contact defines a base section linked to the resilient arm at said fulcrum for retaining the contact in the corresponding passageway

14. The electrical connector as claimed in claim 13, wherein said base section abuts against an inner wall of the base in the corresponding passageway.

15. The electrical connector as claimed in claim 8, wherein said resilient arm extends downwardly generally in said vertical direction from the fulcrum.

16. An electrical connector comprising:

an insulative base defining a plurality of passageways extending in a vertical direction;

an insulative cover mounted upon the base, being moveable relative to the base in a horizontal direction perpendicular to said vertical direction, and defining a plurality of though holes in vertical alignment with the corresponding passageways, respectively;

a plurality of contacts disposed in the corresponding passageways, respectively, each of said contacts defining a resilient arm with a fulcrum, at an upper level, about which the resilient arm is deflected; wherein said contact defines a base section linked to the resilient arm at said fulcrum for retaining the contact in the corresponding passageway, and said resilient arm extends downwardly in generally said vertical direction from the fulcrum for engagement with a conductive pin of an electronic package under a condition that the electronic is seated upon the cover with the conductive pins respectively extending though the corresponding though holes and moveable along with the cover in said horizontal direction to initiate said engagement.

17. The electrical connector as claimed in claim 16, wherein said conductive pins further extend into the corresponding passageways.

18. The electrical connector as claimed in claim 16, wherein said resilient arm is deflected in another horizontal direction opposite to said horizontal direction.

19. The electrical connector as claimed in claim 16, wherein each contact defines a horizontal solder tail exposed below the bottom face of the base.

20. The electrical connector as claimed in claim 19, wherein said tail is located between the adjacent two passageways.

* * * * *